US008104698B2

(12) United States Patent
Hayatani et al.

(10) Patent No.: US 8,104,698 B2
(45) Date of Patent: Jan. 31, 2012

(54) FUEL INJECTION VALVE

(75) Inventors: Masahiko Hayatani, Hitachinaka (JP); Motoyuki Abe, Hitachinaka (JP); Toru Ishikawa, Kitaibaraki (JP); Eiichi Kubota, Ishioka (JP); Takehiko Kowatari, Kashiwa (JP)

(73) Assignee: Hitachi, Ltd., Tokyo (JP)

( * ) Notice: Subject to any disclaimer, the term of this patent is extended or adjusted under 35 U.S.C. 154(b) by 248 days.

(21) Appl. No.: 12/439,102

(22) PCT Filed: Sep. 25, 2006

(86) PCT No.: PCT/JP2006/319621

§ 371 (c)(1),
(2), (4) Date: Feb. 26, 2009

(87) PCT Pub. No.: WO2008/038395

PCT Pub. Date: Apr. 3, 2008

(65) Prior Publication Data

US 2010/0012754 A1 Jan. 21, 2010

(51) Int. Cl.

| | |
|---|---|
| ***B05B 1/30*** | (2006.01) |
| ***F02M 51/00*** | (2006.01) |
| *F02M 47/02* | (2006.01) |

(52) U.S. Cl. ..... 239/585.3; 239/585.1; 239/88; 239/533.3; 239/533.2; 239/533.14

(58) Field of Classification Search ..... 239/88–92, 239/533.2–533.11, 585.1–585.5; 251/129.07
See application file for complete search history.

(56) References Cited

U.S. PATENT DOCUMENTS

| | | | | |
|---|---|---|---|---|
| 6,279,873 | B1 * | 8/2001 | Eichendorf et al. | 251/129.19 |
| 6,874,709 | B2 * | 4/2005 | Ricco | 239/585.1 |
| 7,086,614 | B2 * | 8/2006 | Stier et al. | 239/585.2 |
| 7,775,463 | B2 * | 8/2010 | Abe et al. | 239/585.1 |
| 7,819,344 | B2 * | 10/2010 | Abe et al. | 239/585.2 |
| 2003/0178510 | A1 * | 9/2003 | Kato et al. | 239/585.1 |
| 2006/0006255 | A1 | 1/2006 | Oguma | |

(Continued)

FOREIGN PATENT DOCUMENTS

JP 58-178863 A 10/1983

(Continued)

OTHER PUBLICATIONS

International Search Report dated Jan. 9, 2007 with English translation (Four (4) pages).

(Continued)

*Primary Examiner* — Len Tran
*Assistant Examiner* — James Hogan
(74) *Attorney, Agent, or Firm* — Crowell & Moring LLP

(57) ABSTRACT

In relation to injectors used for internal-combustion engines, it is important to decrease valve closing delay time and also the minimum injection quantity, while these are affected by remanent magnetism in the fixed core, surface tension of the fuel, etc. With reference to a fuel injection valve with a pipe-shaped member to enclose a fixed core and a movable part and further with coils and yokes to cover up the above pipe-shaped member, the anchor to drive the movable member has a plurality of through holes for fuel passage extending in the axial direction, while these through holes are arranged at a certain intervals in the circumferential direction, and projections formed to constitute a contacting surface to touch the fixed core arranged randomly in between the through holes.

6 Claims, 8 Drawing Sheets

U.S. PATENT DOCUMENTS

| | | | | |
|---|---|---|---|---|
| 2010/0065021 | A1* | 3/2010 | Hayatani et al. | 123/476 |
| 2010/0147977 | A1* | 6/2010 | Hayatani et al. | 239/585.5 |

FOREIGN PATENT DOCUMENTS

| | | | |
|---|---|---|---|
| JP | 2000-55229 | A | 2/2000 |
| JP | 2002-295329 | A | 10/2002 |
| JP | 2005-139971 | A | 6/2005 |
| JP | 2005-163712 | | 6/2005 |
| JP | 2006-22721 | A | 1/2006 |

OTHER PUBLICATIONS

Japanese Office Action dated Feb. 8, 2011 (three (3) pages).

* cited by examiner

FUEL INJECTION VALVE

BACKGROUND OF THE INVENTION

1. Field of the Invention

This invention relates to a fuel injection valve used for the internal-combustion engine, and in particular, to a fuel injection valve which has a movable part operated electro-magnetically to open and close a fuel passage.

2. Description of the Related Art

The conventional fuel injection valve of this kind, as described in Japanese Unexamined Patent Application No. 58-178863 or in Japanese Unexamined Patent Application No. 2006-22721, has its movable part configured to include an anchor section in a cylinder like shape, a plunger section located in the center part of the anchor section, and a valve plug provided on the leading end of the plunger section; further, magnetic gap is provided between the end face of a fixed core which has a fuel introduction hole to introduce fuel to the central part and the end face of the anchor, and a magnetic coil is also provided to supply magnetic flux to the magnetic passage including this magnetic gap.

By the magnetic flux penetrating through the magnetic gap, power of magnetic attraction is generated between the end face of the anchor and the end face of the fixed core so as to attract the anchor to the side of the fixed core driving the movable part; thereby it is so configured that the valving element is pulled away from the valve seat permitting the fuel passage in the valve seat to be opened.

In the case of a fuel injection valve configured as above, the collision faces between the end face of the anchor and the end face of the fixed core may stick to each other causing a problem that after the magnetic force has disappeared from the magnetic passage way, it takes a longer time than otherwise for the two sticky faces to return to the default position (a state where the faces get drawn fully apart thus pushing the valving element against the valve sheet).

One of the conceivable reasons for the above is because the anchor and the fixed core get magnetized in the surface to become held to each other by attraction of magnet. One's ingenuity, therefore, should be used here to prevent magnetization of these parts as much as possible.

Another conceivable reason for the above sticky faces is because fluidic cohesion phenomenon occurs when the anchor is attracted and the valve closing motion starts from the opened state of the valve in which the end face of the anchor and the end face of the fixed core are in contact with each other, that is, when separation begins between the end faces of the anchor and the fixed core gradually enlarging the gap for magnetic attraction.

Specifically, the strength of the fluidic force arising in the movement of pasting the anchor on to the fixed core has a property of being proportional to the moving speed of the anchor and inversely proportional to the cube of the gap width.

However, immediately after the open state of the valve starts to transfer to the starting state of closing the valve, the gap is yet too small to permit fluid freely flowing into the gap from the outside. Besides, inertia-gravity of the fluid surrounding the anchor obliges the anchor to move only at a very slow speed. The effect of the above phenomena denotes the behavior as if the end face of the anchor might seem to be pasted on the end face of the fixed core.

In order to moderate the above phenomena, it is important not to disturb, but resultantly to promote a smoother flow of fuel which occurs between the end face of the anchor and the end face of the fixed core and also around the anchor.

In an attempt to alleviate the above problem, a technology disclosed in the conventional art refers to a solution in which only a partial area is to be used as the collision face between the end face of the anchor and the end face of the fixed core so as to make the cohesion phenomenon difficult to occur, thereby preventing sticking.

SUMMARY OF THE INVENTION

However, the above conventional technology was not successful in sufficiently promoting the flow of fuel which occurred between the end face of the anchor and the end face of the fixed core and also around the anchor.

The unsuccess was because the fuel supplied to the outer circumferential portion was done so through a passage of long distance, although the fuel introduced through the fuel introduction passage provided in the center of the fixed core was supplied in most part to the inside diameter portion of the anchor relatively smoothly. In such a conventional technology as described above, the fuel supplied from the inside diameter portion to the outer circumferential portion was not sufficient. The long time which was therefore taken to fully supply the fuel into the gap between the end face of the anchor and the end face of the fixed core consequently became a factor of disturbing the movement of the anchor and delaying response from the movable part.

The object of the present invention is to ensure that fuel can be supplied quickly into the gap between the end face of the anchor and the end face of the fixed core and that the flow of fuel around the anchor can thus be promoted in consequence.

To achieve the above object, in one aspect of the present invention, configuration is made such that the anchor has a concave part formed in the location faced toward the end part of the fuel introduction hole of the fixed core in the central portion of the anchor, convex areas formed at intervals circumferentially at the end parts of the anchor and in contact with the end parts of the fixed core, recesses formed in the remaining portions at the end parts of the anchor, and a plurality of through holes, one end parts of which are opening in those recesses and the other end parts of which are opening around said plunger on the end face opposite to the end face of the fixed core.

With the above configuration, the fuel injection valve of the present invention can witness extremely smooth flow of fuel around the anchor and also a quick supply of fuel to fill up the gap between the end face of the anchor and the end face of the fixed core at a particularly important timing of the movable part transferring from the valve opening position to valve closing action, and this enables the anchor to be detached from the fixed core quickly thereby shortening the valve closing delay time.

BRIEF DESCRIPTION OF THE DRAWINGS

The invention is further described with reference to the accompanying drawings in which.

DETAILED DESCRIPTION OF THE INVENTION

The overall configuration of a preferred embodiment is explained below with reference to FIG. 1 and FIG. 2.

Figure 1:
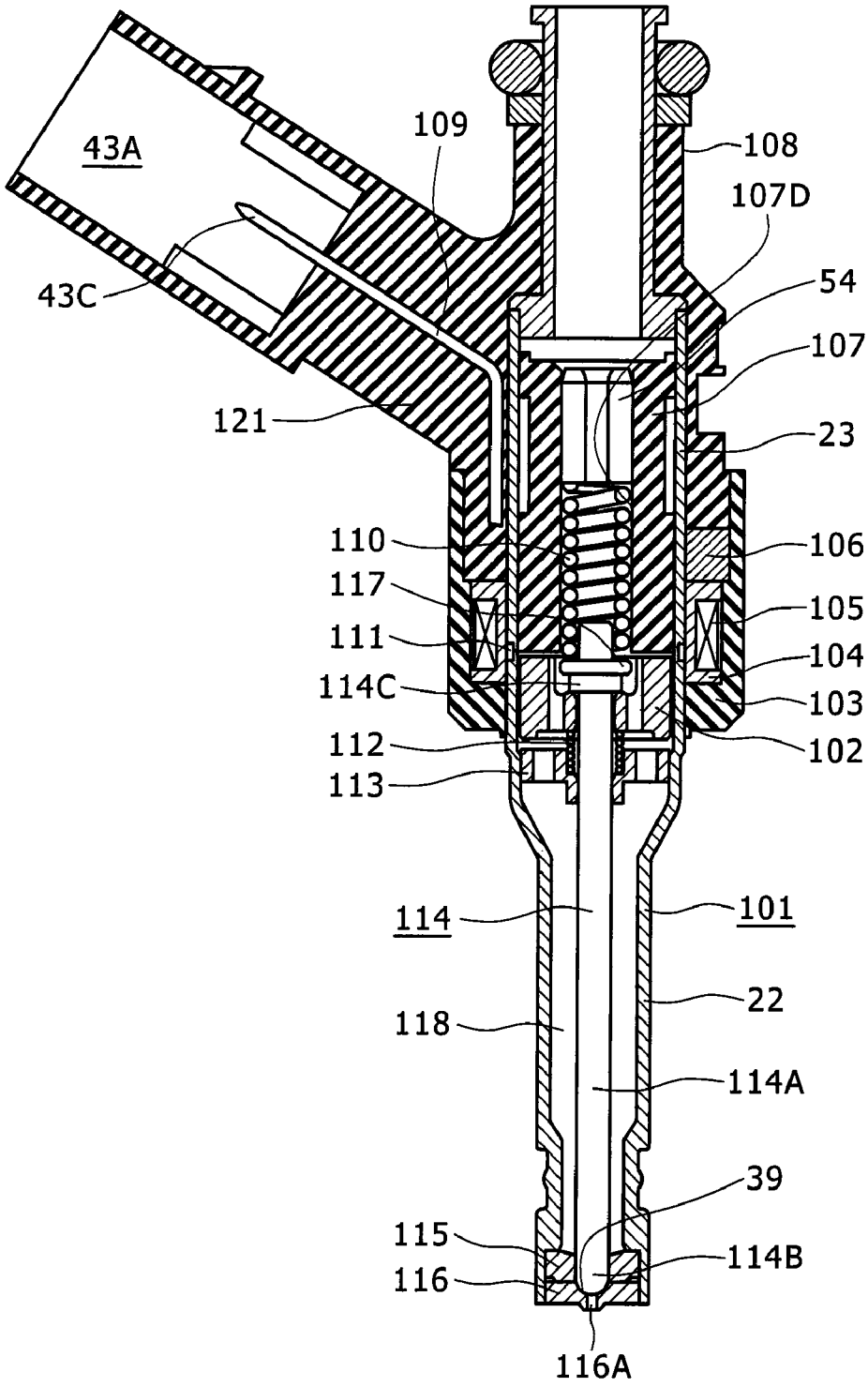
FIG. 1 shows an overall cross-sectional view of the fuel injection valve of an the present invention.

FIG. 1 shows an overall cross-sectional view of the fuel injection valve of the embodiment. FIG. 2 is an enlarged partial cross-sectional view (of FIG. 1) showing the details of the fuel injection valve of the present embodiment.

The nozzle pipe 101 made of metallic material includes a small diameter pipe-shaped part 22 and a large diameter pipe-shaped part 23 which are connected with each other by a circular conic cross-sectional part 24 placed in between.

The small diameter pipe-shaped part 22 has a nozzle assembly formed at its tip. Specifically, a guide member 115 which is to guide fuel toward the center, and an orifice plate 116 provided with a fuel injection orifice 116A are laminated in the described order and inserted into the pipe-shaped part formed inside the tip part of the small diameter pipe-shaped part 22, to be fixed by welding in the circumference of the orifice plate 116 onto the pipe-shaped part.

The guide member 115 is to guide along the outer circumference of a plunger 114A of the movable part 114 to be described later or the valving element 114B provided at the apex of the movable part 114. At the same time, the guide member 115 doubles as a guide for fuel to be led from the outside to the inside in the radiation direction.

The orifice plate 116 has a conical valve seat 39 formed on the side facing the guide member 115. This valve seat 39 is abutted with the valving element 114B provided in the apex of the plunger 114A, facilitating the valving element 114B to either to lead fuel flow to the fuel injection orifice or to shut it off.

Grooves are formed on the outer circumference of the nozzle assembly, and the above grooves are fitted with plastic tip seal or such other sealing materials as represented by a metal gasket covered with rubber by baking.

At the internal lower end part of the large diameter pipe-shaped part 23 of the nozzle pipe 101 of metallic material, the plunger guide 113 to guide the plunger 114A is press-fitted into a draw-formed part 25 of the large diameter pipe-shaped part 23

In the center of the plunger guide 113, there is provided a guide hole 127 to guide the plunger 114A, while the guide hole 127 is surrounded by a plurality of fuel passage borings 126.

Furthermore, the recess 125 is formed by extrusion processing on the upper side in the center This recess 125 is to retain the spring 112.

On the face of the central lower side of the plunger guide 113, the convex portion corresponding to the recess 125 is formed by extrusion processing, and the guide hole 127 for the plunger 114A is provided in the center of the convex portion.

Thus, the plunger 114A in an elongated shape is guided by the guide hole 127 of the plunger guide 113 and the guide hole of the guide member 115 so as to make straight reciprocating movement.

As described above, the nozzle pipe 101 is made of the same metallic material and in one piece from the top to the bottom, and this facilitates easy parts control and efficient workability in assembling.

In the other end portion opposite to the end portion where the valving element 114B of the plunger 114A is located, there is provided a head portion 114C having a diameter larger than that of the plunger 114A and including stepped parts 129 and 133. On the top face of the stepped part 129, the seat for the spring 110 is provided along with a protruding part 131 for the spring guide formed in the center.

The movable part 114 has the anchor 102 provided with a through hole in the center which the plunger 114A runs through. The anchor 102 has a concave part 112A for the spring seat formed in the center of the face on the side facing the plunger guide 113, and a spring 112 is retained in between the concave part 125 of the plunger guide 113 and this concave part 112A.

Since the through hole 128 is smaller in diameter than the stepped part 133 of the head portion 114C, the lower end face of the inner circumference of the stepped part 129 of the head portion 114C of the plunger 114A is abutting, and therefore, is in engagement with, the bottom face 123A of the concave part 123 formed on the upper side face of the anchor 102 retained by the spring 112, under the effect of the energizing power of the spring 110 by which the plunger 114A is pressed on to the valve seat of the orifice plate 116, or under the effect of gravity force.

In view of the above structure, the upward movement of the anchor 102 against the energizing power of the spring 112 or the gravity force, or otherwise, the downward movement of the plunger 114A conforming to the energizing power of the spring 112 or the gravity force can be worked out with both the anchor 102 and the plunger 114A being cooperative with each other.

However, in the case where the force for upward movement of the plunger 114A or for downward movement of the anchor 102 acts individually and independently on the above two parts without regard to the energizing power of the spring 112 or the gravity force, it may happen that both the parts move in different directions respectively.

In the above case, it is noted that there is fluid film existing in a minim gap of 5 to 15 microns between the outer circumferential face of the plunger 114A and the inner circumferential face of the anchor 102 in relation to the through hole 128. When the two parts starts moving in different directions, this fluid film causes friction so as to limit their movements; that is, the fluid film puts on the brakes to counter any quick displacements of the two parts.

If the movement is slow, the fluid film shows little resistance.

Therefore, any such momentary movements of the two parts into the opposite directions are attenuated within a short time.

In this connection, the center position of the anchor 102 is maintained not by the relation between the inner circumferential face of the large diameter pipe-shaped part 23 and the outer circumferential face of the anchor 102, but by the relation between the inner circumferential face of the through hole 128 of the anchor 102 and the outer circumferential face of the plunger 114A. The outer circumferential face of the plunger 114A also serves as a guide for the anchor 102 to move along the axial direction independently.

The lower end face of the anchor 102 faces the upper end face of the plunger guide 113, but the two are not in direct contact with each other because the spring 112 exists in between separating the two.

A side gap 130 is provided between the outer circumferential face of the anchor 102 and the inner circumferential face of the large diameter pipe-shaped part 23 of the nozzle pipe 101 made of metal material. This side gap 130 is designed to be larger than the minimum gap of 5 to 15 microns formed between the outer circumferential face of the plunger 114A and the inner circumferential face of the anchor 102 in relation to the through hole 128 in order to allow the movement in the axial direction of the anchor 102; actually, the side gap 130 is made up to be about 0.1 mm for example. Since magnetic resistance increases as the side gap becomes too large, the gap needs to be determined with the above matter in consideration.

Into the inner circumferential part of the large diameter pipe-shaped part 23 of the nozzle pipe 101 made of metal material, the fixed core 107 is press fit; on to the top end part of the fixed core 107, the fuel introduction pipe 108 is press fit and is jointed together by welding at the press-fitting contact position where the large diameter pipe-shaped part 23 of the nozzle pipe 101 meets with the fuel introduction pipe 108. With this welding joint, any possible gap which might otherwise be formed and allow fuel to leak through from the inside of the large diameter pipe-shaped part 23 of the nozzle pipe 101 to the outside air is tightly closed.

Provided in the center of the fuel introduction pipe 108 and the fixed core 107 is a through hole having a diameter D which is slightly larger than the diameter of the head portion 114C of the plunger 114A.

In the inner circumference of the lower end part of the through hole 107D as the fuel introduction passage of the fixed core 107, the head portion 114C of the plunger 114A is inserted out of touch with any other parts, and the gap given between the inner lower end edge 132 of the through hole 107D of the fixed core 107 and the external edge part 134 of the stepped part 133 of the head portion 114C is as large a gap as comparable to the side gap described above. This is aimed at making the gap larger than the clearance (approximately 40 to 100 microns) of the anchor 102 to the inner circumference edge part 135 and thereby decreasing leakage of magnetic flux from the fixed core 107 to the plunger 114A to as little a level as possible.

The lower end of the spring 110 for initial load setup is abutting the spring seat 117 formed on the upper end face of the stepped part 133 provided in the head portion 114C of the plunger 114A, and the other end (the upper end) of the spring 110 is held down by the adjustment part 54 press-fit into the through hole 107D of the fixed core 107; the spring 110 is thus fixed between the head portion 114C and the adjustment part 54.

By adjusting the setting position of the adjustment part 54, it is possible to adjust the initial load with which the spring 110 presses the plunger 114A onto the valve seat 39.

Stroke adjustment of the anchor 102 is conducted as follows. After the magnet coils (104 and 105) and the yokes (103 and 106) are set to the external circumference of the large diameter pipe-shaped part 23 of the nozzle pipe 101, the anchor 102 is to be set in the large diameter pipe-shaped part 23 of the nozzle pipe 101, and the plunger 114A is to be inserted in the anchor 102; in that state, plunger 114A is pushed down with a jig to the position where the valve is closed; while the magnet coil 105 is being energized for detection of strokes of the movable part 114, the fixed core 107 is adjusted so as to determine its press-fitting position, thereby enabling the movable part 114 to take any desired stroke position.

Figure 2:
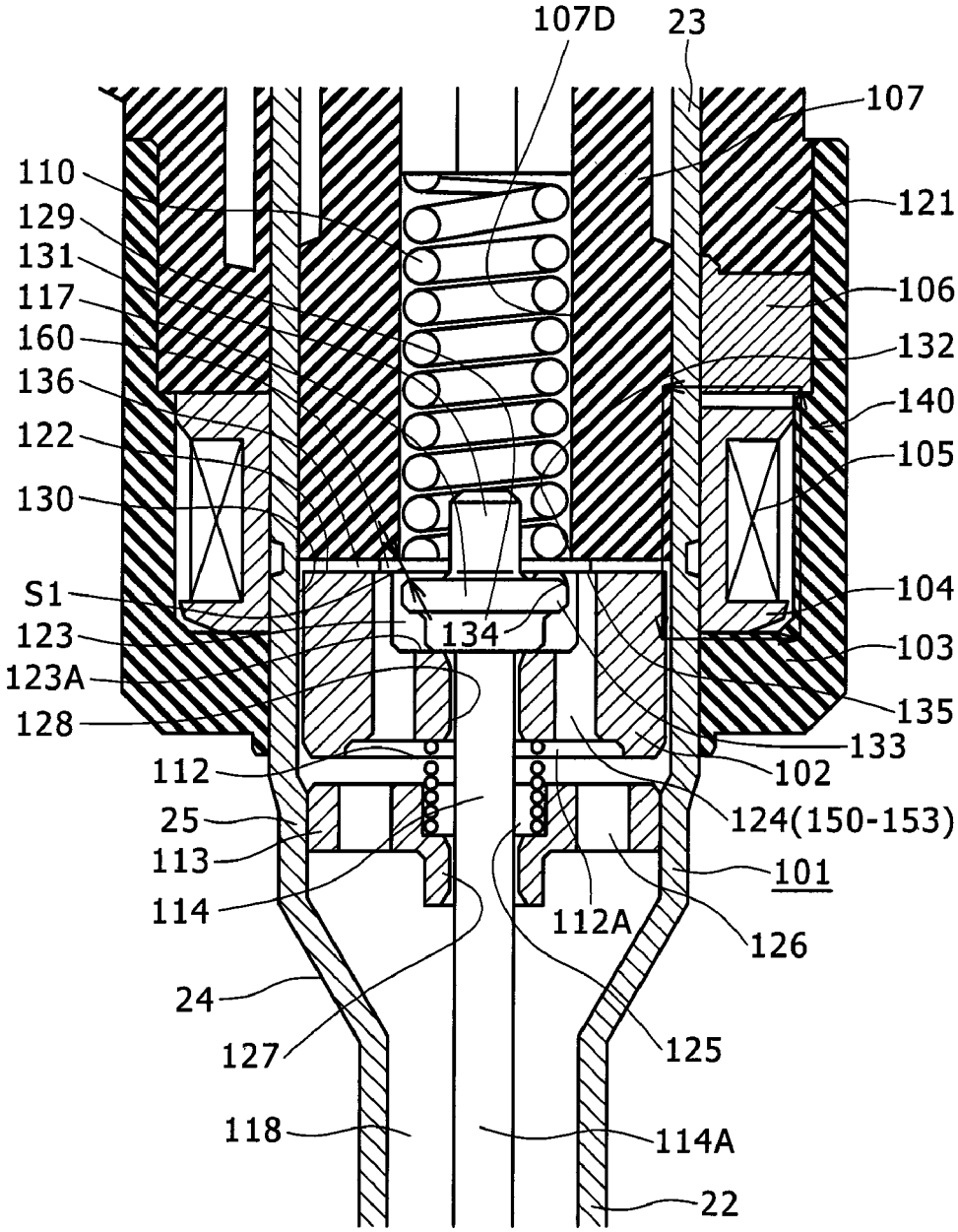
FIG. 2 is an enlarged cross-sectional view of a part of the fuel injection valve of an embodiment of the present invention.

As shown in FIG. 1 and FIG. 2, the valve is configured that, in the state of the initial load setup spring 110 having been adjusted for proper initial load, the lower end face of the fixed core 107 is to face the upper end face 122 of the anchor 102 keeping in between a magnetic attraction gap 136 of about 40 to 100 microns (exaggerated in the drawing) The outside diameter of the anchor 102 is only slightly smaller (about 0.1 mm) than the outside diameter of the fixed core 107. On the other hand, the through hole 128 located in the center of the anchor 102 has an inside diameter which is slightly larger than the outside diameter of the plunger 114A and the valving element 114B of the movable part 114. Also, the inside diameter of the through hole of the fixed core 107 is slightly larger than the outside diameter of the head portion 114C. And, the outside diameter of the head portion 114C is larger than the inside diameter of the through hole 128 of the anchor 102.

The above structure ensures enough area for the lines of magnetic force in relation to the magnetic attraction gap 136, and at the same time, secures enough space for engagement in the axial direction between the lower end face of the head portion 114C of the plunger 114A and the bottom face of the recess of the anchor 102.

In the external circumference of the large diameter pipe-shaped part 23 of the nozzle pipe 101 made of metal material, there are fixed the cup-shaped yoke 103 and the ring-like upper yoke 106, the latter yoke appearing as if it were to cover the opening side of the former yoke.

In the bottom part of the cup-shaped yoke 103, there is provided a through hole in the center, into which the large diameter pipe-shaped part 23 is inserted.

The external circumferential wall part of the cup-shaped yoke 103 faces the external circumferential surface of the large diameter pipe-shaped part 23 of the nozzle pipe 101 made of metal material, forming an external circumferential yoke part.

The external circumference of the ring-like upper yoke 106 is press-fit into the inner circumference of the cup-shaped yoke 103.

Inside the pipe-shaped space formed by the cup-shaped yoke 103 and the ring-like upper yoke 106, there are disposed ring-shaped or pipe-shaped magnetic coils 105.

The magnetic coil 105 comprises a ring-shaped coil bobbin 104 which has an opening directed outward in the radial direction and also has a cross section with a U-shape groove, and a ring-shaped coil 105 formed by copper wire wound in the groove of the coil bobbin.

The magnetic coil device is composed of the bobbin 104, the coil 105, the cup-shaped yoke 103, and the upper yoke 106.

At the starting and finishing ends of winding of the coil 105, rigid conductors 109 are fitted; the conductors 109 are then pulled out from the through-hole provided on the upper yoke 106.

Insulative resin is to be injected to the inner circumference of the upper end opening of the cup-shaped yoke 103 and the upper area of the upper yoke 106 covering the conductor 109, the fuel introduction pipe 108, and the external circumference of the large diameter pipe-shaped part 23 of the nozzle pipe 101 with resin, so that these areas may be turned into one resin molded unit 121.

Thus, a toroidal form of magnetic flux lines 140 as indicated by the arrow mark 140 is created around the magnetic coils 104 and 105.

A connector 43A formed at the apical end of the conductor 43C is connected with a plug to which electric power is supplied from the power source of a battery, and whether the line is electrified or not is controlled by a controller not shown in the drawing.

While the coil 105 is electrified, the magnetic flux in the magnetic flux lines 140 causes magnetic attraction force at the magnetic attraction gap 136 between the anchor 102 of the movable part 114 and the fixed core 107, resulting that the anchor 102 moves upward being attracted by a level of force exceeding the setup load of the spring 110. In this connection, the anchor 102 moves upward together with the plunger 114A in engagement with the head portion 114C of the plunger until the upper end face of the anchor 102 strikes on the lower end face of the fixed core 107.

As a result, the valving element 114B in the in the apex of the plunger 114A is separated off the valve seat 39 permitting fuel to go through the fuel passage 118 and spurt out through a plurality of fuel injection orifices 116A into a firing chamber.

If electrification of the magnetic coil 105 is cut off, magnetic flux disappears from the magnetic flux lines 140, and so does the magnetic attraction force at the magnetic attraction gap 136.

In the above state, the force of the spring 110 for initial load setup that pushes back the head portion 114C of the plunger 114A to the opposite direction is strong enough to overcome the force of the spring 112 and act on all of the movable part 114 (the anchor 102 and the plunger 114A).

As a result, the anchor 102 of the movable part 114 with any magnetic attraction force now dissipated is pushed back by the force of the spring 110 to the closed position where the valving element 114B touches the valve seat.

At the same time, the stepped part 129 of the head portion 114C gets to abut on the bottom face 123A in the recess of the anchor 102 and makes the anchor 102 move over to the side of the plunger guide 113 overcoming the force of the spring 112.

If the valving element 114B strikes on the valve seat with a great force, the plunger 114A bounces back toward the direction to compress the spring 110.

However, as the anchor 102 is independent of the plunger 114A, the plunger 114A tends to move to an opposite direction from the movement of the anchor 102.

At the same time, friction is generated due to fluid between the outer circumference of the plunger 114A and the inner circumference of the anchor 102, and the energy of the bouncing-back plunger 114A is attracted by the inertial mass of the anchor 102 which is about to move by the still active inertial force in the opposite direction (the direction for the valve to close).

At the time of bouncing-back, the anchor 102 that has a large inertial mass is cut off from the plunger 114A, and therefore, the bouncing-back energy itself becomes small.

Also, the anchor 102 that has attracted the bouncing-back energy of the plunger 114A has decreased its own inertial force by that much. Accordingly, the energy necessary for compression of the spring 112 has also decreased with the result that repulsive force of the spring 112 becomes small and that the phenomenon of the plunger 114A being moved toward the valve-opening direction owing to bouncing-back of the anchor 102 itself is likely to become difficult to occur.

Thus, the bouncing-back of the plunger 114A is kept to a minimum, and the so-called secondary fuel spurting phenomenon, which means opening of the valve after electrification of the magnetic coils (104 and 105) is cut off followed by spurting-out of fuel by omission, is withheld.

What is required here is that the fuel injection valve needs to have the ability to respond to the valve opening signal and carry out opening and closing actions quickly. That is, it is important to shorten as much as possible the delay time from the rise of valve opening pulse signal to actualization of valve opening state (valve opening delay time) and also the delay time from the end of valve opening pulse signal to actualization of valve closing state (valve closing delay time), from the view to make further reduction in the amount of a controllable fuel injection (minimum injection quantity). It is especially well known that shortening valve opening delay time is effective in reduction in minimum injection quantity.

One of the methods for shortening the valve closing delay time is to increase the setup load of the spring 110 which applies force for the movable part 114 to transfer the valving element 114B from the valve opening state to the valve closing state. But, if the setup load is strengthened, it leads to a contradicting problem that a large force becomes necessary at the time of valve opening necessitating an enlarged size of the magnetic coil. Because of design limitation deriving from the above, the abovementioned method alone cannot be enough to shorten the valve opening delay time as required.

As another method, it is conceivable that when the anchor 102 being attracted by the magnetic attraction force of the fixed core 107 is pressed down by the spring 110, the magnetic gap 136 between the lower end face of the fixed core 107 and the upper end face 122 of the anchor 102 may lapse into a state of negative pressure, and that the fuel pushed aside due to the movement of the anchor 102 may take advantage of the above state of negative pressure so as to be inpoured quickly into the magnetic gap 136 from the fuel passage 118.

Hereafter, explanation is made of an embodiment based on the above-mentioned principle. According to the first embodiment, in order to shorten the valve closing delay time, the anchor 102 is provided with a through hole for fuel passage 124 to let the fuel flow in the axial direction; this through hole 124 and the fuel supply passage (the side gap) 130 provided on the side face of the anchor 102 are made to communicate with each other by utilizing the magnetic gap between the upper end face of the anchor 102 and the lower end face of the fixed core 107.

By forming the fuel supply passage in a discontinuous manner according to the above configuration, the area of the contacting surface between the upper end face of the anchor 102 and the lower end face of the fixed core 107 can be secured only as much as necessary from the magnetic and impact-resistant viewpoint, while the magnetic attraction force acting on the upper end face 122 of the anchor 102 can also be made hard to be decreased.

Also, it becomes possible to limit the contact area to the necessary minimum and reduce stiction due to squeeze effect caused when attraction occurs between the lower end face of the fixed core 107 and the upper end face 122 of the anchor 102. Further, it is so configured that if negative pressure acts between the two, the fuel within the fuel passage 118 pushed aside by the anchor 102 can be drawn to the magnetic gap 136 quickly via the through hole of the anchor 102.

Figure 3A:
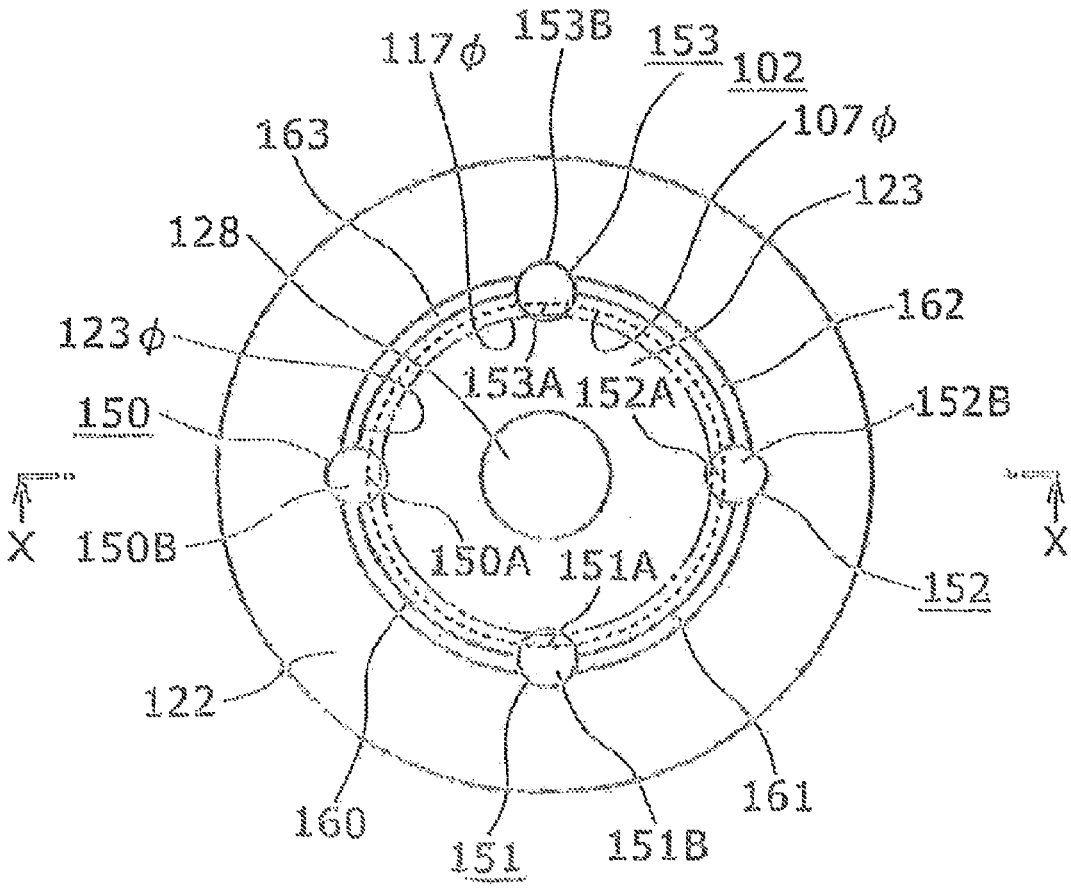
FIG. 3A shows a plain view of the anchor according to a first embodiment of the present invention.
Figure 3B:
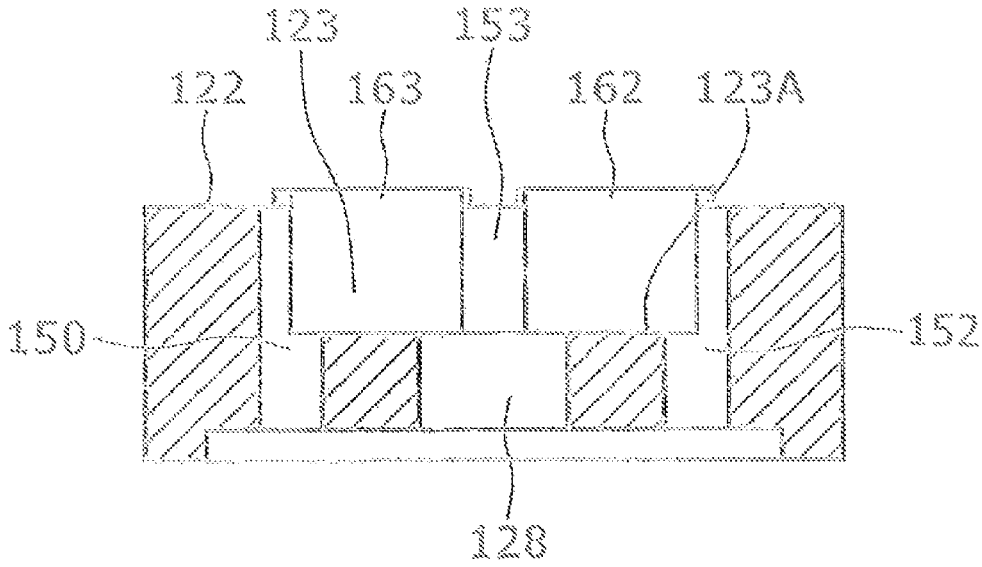
FIG. 3B shows a cross-sectional view along the line X-X in FIG. 3A.

FIGS. 3A and 3B show block diagrams of the anchor 102 according to the first embodiment of the present invention. FIG. 3A is a plain view viewed from the side of the plunger head portion 114C, and FIG. 3B is a cross-sectional view along the line X-X in FIG. 3A.

The anchor 102 has in its center the recess 123, and in the center of the basal plain 123A in the recess 123, the through hole 128 is bored to let the plunger 114A of the movable part 114 run through.

Four vertical grooves 150B to 153B each having a semicircle cross-section constituting a part each of the through holes for fuel passage 150, 151, 152, and 153 are formed on the inside circumferential wall of the recess 123, each equally spaced in discontinuous manner. The vertical grooves 150B to 153B, when reaching the basal plain 123A in the recess 123, pass through the basal plain 123 with the openings straightly appearing on the end face opposite to the end face of the fixed core. The through holes 150, 151, 152, and 153 are formed with the cross-section of normal round shape in the portion from the basal plain 123A upward. As a result, the through holes 150A to 153A each having a semicircle cross-section jutting forth from the external circumference toward the center side are formed on the basal plain 123A. In the first embodiment, the through holes 150A to 153A each with the semi-circle cross-section and the vertical grooves 150B to 153B, when both are combined together, are to constitute the through holes 150 to 153 each of which has a cross-section of a full circle. Either of the through holes 150A to 153A or the vertical grooves 150B to 153B, both with semicircle cross-sections, may be larger than the other in diameter. Also, the shape of cross-section may be rectangular or any other shape. Anyhow, it is necessary that at least a part of the cross-section should be located on, or on the way to, the basal plain 123A of the recess 123 of the anchor 102, but the opening should be located in a place recessed from the end face 122 of the anchor 102; it is also necessary that the remaining portion should be placed with a step at the end face 122 of the anchor 102 or nearer to the end face 122 of the anchor 102 than the above-mentioned part of the cross section.

Also, it is configured that a part of each through hole 150 to 153 is formed in the inner side of the fuel introduction hole 107D of the fixed core, while the remaining portion other than the above one part is formed in the outer side of the diameter. And, it is so configured further that the location of the upper end openings of the through holes 150 to 153 disposed in the inner side of the fuel introduction hole 107D may be formed in a place more distant from the end face of the fixed core than the location of the upper end openings of the through holes 150 to 153 disposed in the outer side of the fuel introduction hole 107D.

In the embodiment configured as above, the fuel flowing in through the fuel introduction hole 107D of the fixed core 107 flows into the through hole 150 to 153, and at the same time, communicates with the outside in radial direction of the end face of the anchor 102 via the openings of the through hole, with the result that the fuel can come in and go out of the magnetic gap quickly.

Back to FIG. 3, on the end face 122 of the anchor 102, the contacting surfaces 160, 161, 162, and 163 to contact the end face 122 of the anchor 102 are arranged in between the through holes 150 to 153 for fuel passage.

FIG. 2 is a drawing showing the injection valve as is attached with the above anchor 102 and in the state that the anchor 102 is being attracted by the fixed core 107 via the magnetic attraction gap 136. Incidentally, the magnetic attraction gap 136 or the contacting surface 160 are shown in a magnified form.

With the coil 105 given the valve opening pulse signal, the anchor 102 is attracted to the fixed core 107 by the magnetic attraction of the magnetic flux lines 140 until the contacting surface 160 gets in contact with the fixed core 107. In accordance with the foregoing motions, the movable part 114 in concert with the anchor 102 is pulled up. And, the fuel is transported by way of the through hole 150 of the anchor 102, the fuel passage 126 of the plunger guide 113, the fuel passage 118, and raised valving element 114B, before being ejected from the fuel injection orifice.

When the valve opening pulse signal is terminated, the magnetic attraction force from the magnetic flux lines 140 disappears, and the anchor 102 is released from the attraction from the fixed core 107. The anchor 102 is pushed down by the pressing force of the spring 110 to make the valving element 114B to sit on the valve seat 39 to the effect of closing the fuel injection orifice 116A and terminating fuel injection.

When the valving element 114B is pushed down to close the fuel injection orifice 116A, the fuel pushed aside is made to flow, reversely against the case of injection, by way of the fuel passage 118, the fuel passage 126 of the plunger guide 113, and the through holes for fuel passage 150 to 153 of the anchor 102; as fluid resistance in the above flow route for fuel has been able to be made small, it has become possible to shorten the valve closing delay time.

Explanation is made hereinbelow on the necessary operations to further shorten the valve closing delay time.

In the state of the valve being open when the anchor 102 is magnetically attracted by the fixed core 107, the upper end face 122 of the anchor 102 makes no contact at all but only the contacting surface 160 does.

Stiction due to the squeeze effect acting to separate liquid from two surfaces between which the liquid is sandwiched shows a very small value as compared with the case where the whole of the upper end face 122 is in tight contact with the fixed core 107. The foregoing is evident in view of the fact that theoretically the stiction due to the squeeze effect has a proportional relation with the contact area and is also proportional to one divided by the gap distance to the third power.

Therefore, it is intended to keep small the stiction area to the fixed core 107 by providing the contact area 160, and to maintain a certain distance of the magnetic attraction gap 136 by forming the convex area (contacting surface); thereby, it is attained to diminish the stiction force due to the squeeze effect.

After ending of the valve opening pulse signal, magnetic attraction force disappears, and the anchor 102 is released from the attraction of the fixed core 107. As the stiction force due to the squeeze effect caused at the magnetic attraction gap 136 has become small by virtue of the present invention, the valving element 114B is pressed down, and the fuel pushed aside thereby flows into the through hole for fuel passage 150 and is drawn quickly into the magnetic attraction gap 136 which is in a state of negative pressure.

The contacting surfaces 160, 161, 162, and 163 of the anchor 102 are formed discontinuously so as not to overlap the through holes 150, 151, 152, and 153, and this assists the fuel to flow all the more smoothly. The contacting surfaces discontinuously disposed permit different fuel passages to exist, each of the fuel passages performing communication between inside and outside of the colliding part. The effect available therefrom enables fuel to be supplied to the outside of the outside diameter, not only through the gaps on the outside face of the anchor but also through the main fuel passages on the center side of the core, thus ensuring smoother feed of fuel to the magnetic gap. As a result, it has become possible to reduce the stiction force due to the squeeze effect, even if the initial speed of the anchor is relatively fast In the first embodiment, configuration is made in such a manner that the fixed core 107 may be contacted only by the contacting surface 160 of the anchor 102 and further that the contacting surfaces 160, 161, 162, and 163 may not overlap the through holes 150, 151, 152, and 153. In other words, the anchor has a plurality of through holes for fuel passage 150 to 153, each extending in the axial direction, and the same through holes 150 to 153 being arranged at specific intervals in the circumferential direction, while the contacting surfaces 160 to 163 are formed as the convex end faces in between the through holes 150 to 153.

The contacting surface is segmentalized by the through holes 150 to 153 to become discontinuous, making the discontinuous part the easiest point for the fuel to be supplied from. That is, since the through holes 150 to 153 also communicate with the concave part provided in the anchor and, together with the fuel passages provided in the center of the fixed core, constitute main fuel passages with a large total cross-sectional area. Because the contacting surface is segmentalized by the fuel passages with a large cross-sectional area, supply of fuel to the magnetic gap is conducted also from the through holes 150 to 153 in addition to the inner circumference of the anchor and the outer circumference of the anchor. Further, since the through holes 150 to 153 also communicate with the lower part of the anchor, fuel is pushed out with the movement of the anchor, and the most part of the fuel moving to the magnetic gap does so via the through holes. In this connection, the contacting surfaces 160 to 153 segmentalized by the through holes 150 to 153 are laid out in close vicinity to the through holes and, therefore, can be supplied with fuel without being affected by the narrowness of the passages. As a result, fuel feeding to the magnetic gap and the colliding parts has become easier, and it also has become possible to reduce the force, namely stiction, due to the squeeze effect. As the force of stiction due to the squeeze effect is inversely proportional to a cube of the gap, it is effective to smoothly carry out fuel supply to colliding end parts where the gap becomes extremely narrow.

As a result, the movable part 114 can act quickly after ending of the valve opening pulse signal so that the valving element 114B can push down the fuel injection orifice 116A, exhibiting effectiveness in shortening the valve closing delay time. More specifically, the time from ending of electrification of the coil to starting of valve opening action can be shortened, leading to the shortened valve closing delay time. This will result in a possible reduction in minimum injection quantity of a controllable fuel injection valve. Or otherwise, if a low minimum injection quantity is not required, it becomes possible to reduce the set load of the energizing spring. As an outcome, this permits the power of magnetic attraction to tend to overtake that of the energizing spring and also enables the fuel injection valve to have an amplified maximum fuel pressure which the valve is able to work on.

In FIG. 3, the contacting surfaces 160, 161, 162, and 163 are configured to be continuous in between the through holes 150, 151, 152, and 153 but to be discontinuous at each part of the throughholes. However, continuation of the contacting surfaces is not necessarily indispensable in between the through holes 150, 151, 152, and 153. For instance, even in between the through holes 150, to 153, formation of any discontinuous part in the middle of the contacting surfaces would not affect but produce similar function and effect.

In the present invention, no particular mention is made of any fuel used for a fuel injection valve, but the present invention is applicable to gasoline, light oil, alcohol, and all other kinds of fuel used for internal-combustion engines. This is because the present invention is based on the viewpoint of the viscosity resistance. Whatever fluid may be used, the fluid has a certain viscosity resistance, the basic concept on which the principle of the present invention is made applicable and effective.

In case of an alcohol fuel and if sticking occurs to each other between the lower end face of the fixed core 107 and the upper end face of the anchor 102 in the absence of the contacting surfaces 160, 161, 162, and 163, an attempt to draw them apart from each other under the influence of negative pressure due to the squeeze effect may cause aeration or cavitation owing to the air melting in the alcohol fuel, leading to the damage of the lower end face of the fixed core 107 and the upper end face 122 of the anchor 102, resulting in damaged reliability of the valve. The lower the pressure of the fuel supplied to the fuel injection valve is, the more apparently this tendency shows up. Therefore, if the fuel supply can be conducted smoothly to the contacting surfaces 160 to 163 as in the present invention to reduce the negative pressure caused in the end parts, it becomes possible to reduce aeration or cavitation occurring from the colliding end face of the fixed core 107, the upper end face 122 of the anchor 102, and the colliding end parts 160 to 163, resulting in enhanced durability and reliability.

For the purpose of enhancing durability, plating is applied sometimes to the lower end face (colliding end face) of the core 107, the upper end face 122 of the anchor 102, and the contacting surfaces 160 to 163. The effect of suppressing generation of aeration or cavitation according to the present invention is as well effective for preventing peel-off or other failures in plating. As a result, it has become possible to ensure durability and reliability by adopting hard chrome plating or non-electrolytic nickel plating even when soft magnetic stainless steel of a relatively soft quality has to be used as a material of the anchor. Particularly meritorious is that such a plating method as non-electrolytic nickel plating set by heat treatment becomes available. The use of non-electrolytic nickel plating facilitates keeping coated thickness in high accuracy, enhancing precision level of finished products, and reducing data spread.

In addition to the above, the discontinuous contacting surfaces 160, 161, 162, and 163 provided on the anchor 102 can contribute to achieving the effect of decreasing the stiction force due to the squeeze effect and also of diminishing damage attributable to collision between the lower end face of the fixed core 107 and the upper end face 122 of the anchor 102.

With reference to FIG. 3, the solid line 123ϕ denotes the diameter of the recess 123 or the inner circumferential wall. The dotted line 107ϕ denotes the inside diameter of the fuel introduction hole 107D of the fixed core 107. Also, the dashed-dotted line 117D denotes the outside diameter of the spring seat 117 formed in the head portion 114C of the plunger 114A. As shown in FIG. 3 and FIG. 2, the fuel introduced from the lower end of the fixed core 107 to the recess 123 is done so through the fuel passage formed between the inside circumferential edge 132 of the fixed core 107 and the upper-end outside circumference of the spring seat 117. The flow of fuel is made to be smooth since the openings of the through holes 150 to 153 are formed immediately down the stream (almost right down below) of the above fuel passage. The fuel that flows from the side of the fuel passage 118 through the through holes 150 to 153 smoothly flows into the negatively pressurized magnetic attraction gap 136 located between the end face 122 of the anchor 102 and the end face of the fixed core 107. In other words, the fuel flow runs just smoothly because formation of the fuel passage is almost straight from the fuel introduction hole 107D to the fuel passage 118. Furthermore, particularly in the part of the magnetic attraction gap, a part of the through holes 150 to 153 expands itself in such a way as the recess 123 is made to blow out toward the outside in the radial direction, so that the fuel coming through the gap S1 formed between the lower-end inside circumferential edge 132 of the fixed core 107 and the upper-end outside circumferential edge 134 of the spring seat 117 and the fuel coming from the recess 123 may smoothly flow into the magnetic attraction gap 136 between the end face 122 of the anchor 102 and the end face of the fixed core 107.

Configuration is so made in this connection that the total cross-sectional passage area of the through holes 150 to 153 may become larger than that of the fuel passage formed by the gap S1. By adopting this configuration, the cross-sectional area of fuel passage grows wider as the fuel flows forward, and so much the smoother does the fuel flow.

Since the recess 123 is provided in the downstream of the fuel passage formed by the gap S1 as a dilated portion of the fuel passage, the fuel coming through the gap S1 can be smoothly fed to the magnetic attraction gap 136 as well as to the through holes 150 to 153. In the above fuel feeding, the upper end parts of the grooves 150B to 153B serve the function of supplying fuel smoothly from the side of the recess 123 to the upper end face 122 in the outside of the anchor 102.

The depth of the recess 123 may be selected properly depending on the dimension of the head portion 114C of the plunger 114A. One condition is that the depth of the recess 123 should be larger than the inside diameter of the fixed core, but how large it should be needs to be determined considering the magnetic characteristics in relation to the fixed core 107. In the first embodiment, sufficient magnetic characteristics can be obtained even if the depth is expanded up to the outermost diameter of the through holes 150 to 153.

Also, the total cross-sectional passage area of the through holes 150 to 153 is configured to be larger than the cross-sectional area of the plunger through hole 128.

In the above way, it becomes possible to obtain a total cross-sectional fuel passage area which is larger than what is available than when through holes are provided in the plunger. While the configuration according to the first embodiment should naturally be maintained, it may as well be practiced to enlarge fuel passages by providing additional through holes in the center or in the external circumferential part of the plunger 114A.

Figure 4A:
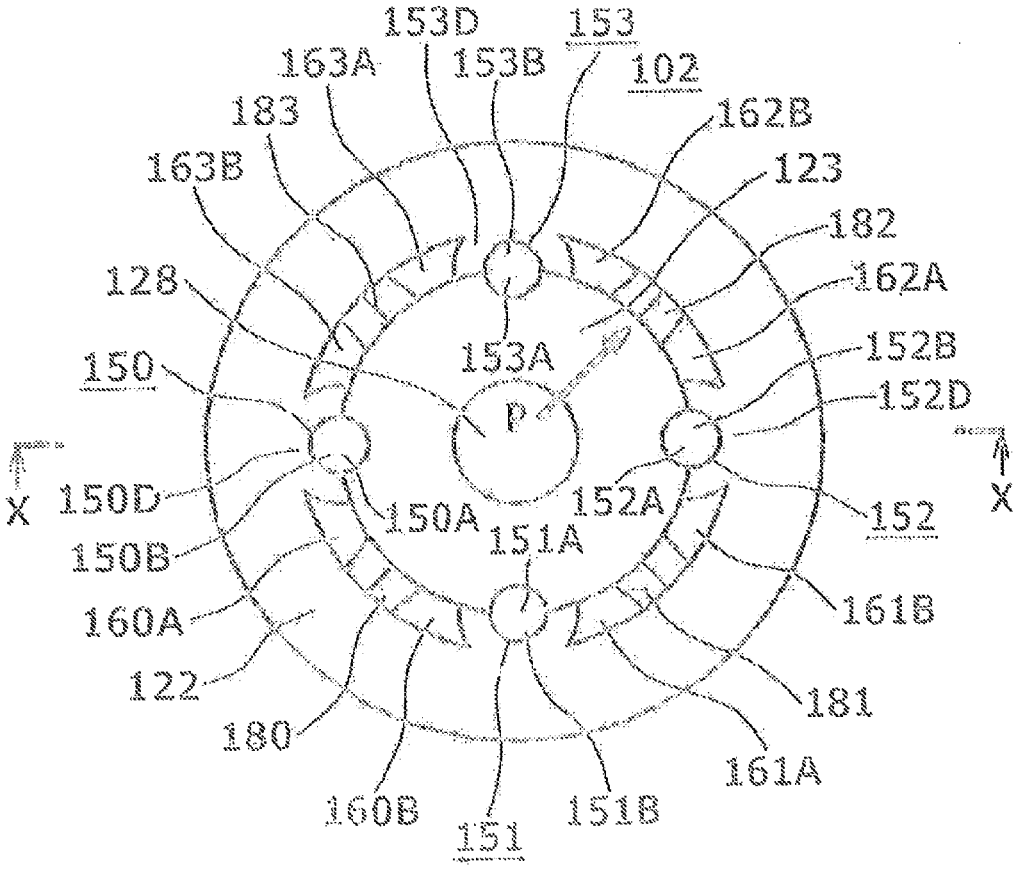
FIG. 4A shows a plain view of the anchor according to a second embodiment of the present invention.
Figure 4B:
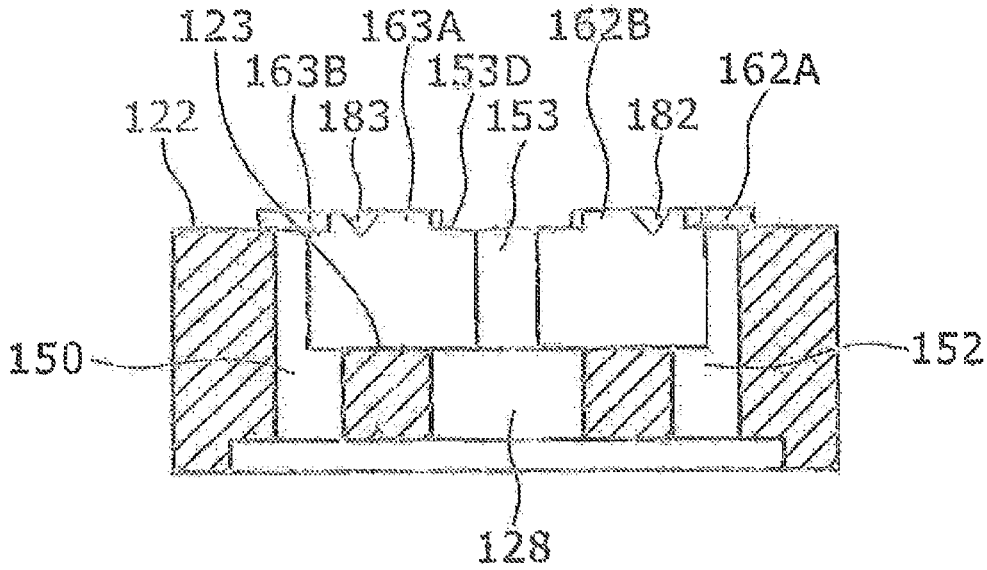
FIG. 4B shows a cross-sectional view along the line X-X in FIG. 4A.

Next, explanation is made of a second embodiment based on FIG. 4.

Figure 5:
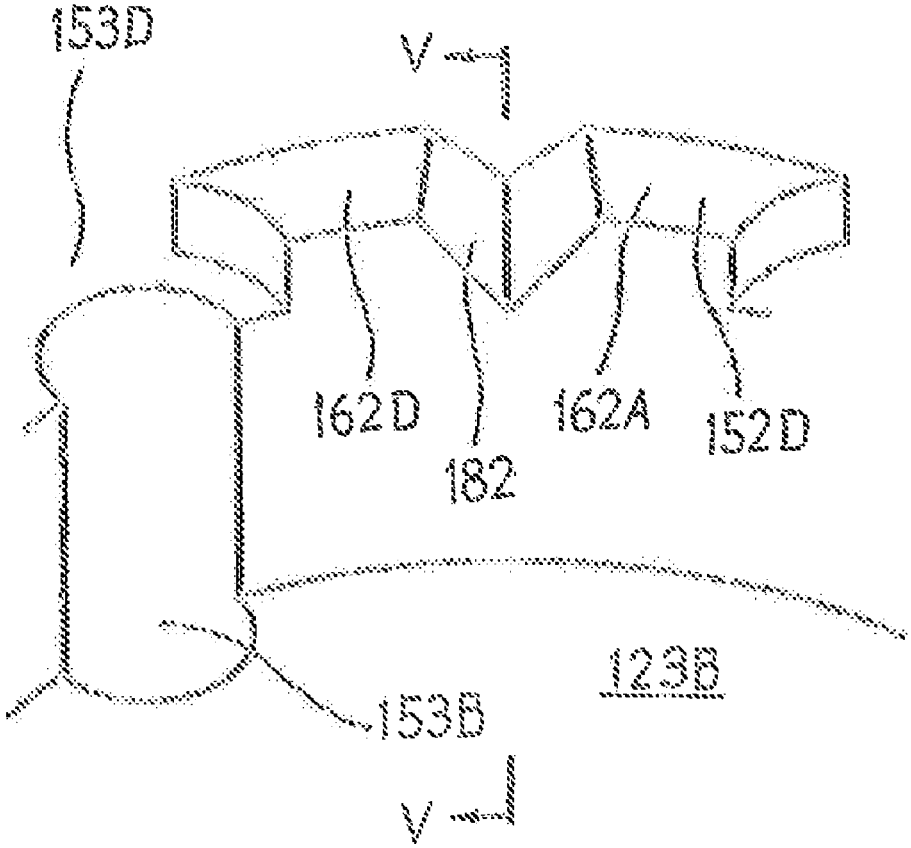
FIG. 5 is an enlarged partial perspective view of the anchor viewed from the position P of FIG. 4A.
Figure 6:
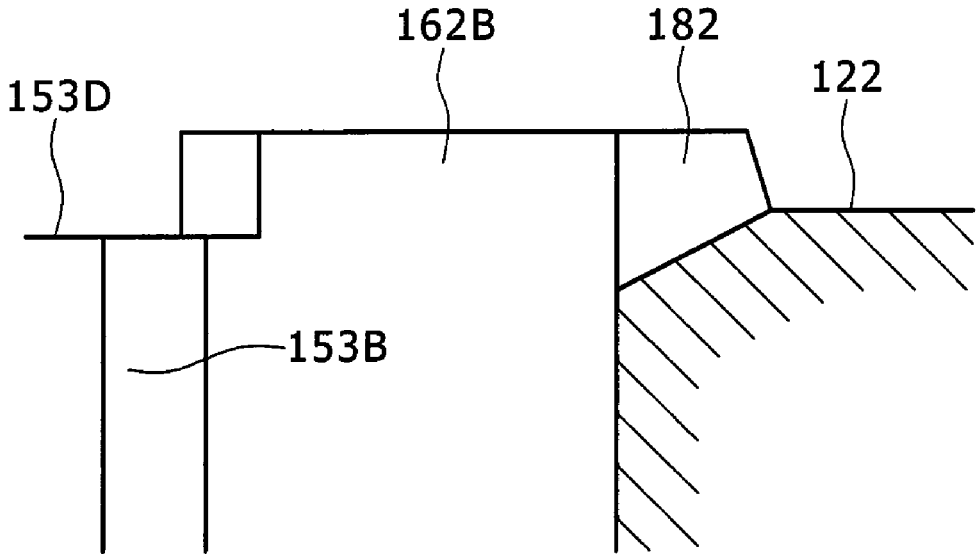
FIG. 6 is a cross-sectional view along the line of Y-Y in FIG. 5.

According to the embodiment shown in FIG. 4 to FIG. 6, the depressions 150D to 153D have been provided on around the upper ends of the grooves 150B to 153B of the through holes 150 to 153 with the aim of augmenting communicating passages between the internal circle and the external circle at the end face of the anchor 102.

Further, the V-shape grooves 180 to 183 have been provided in each interval in between 150D to 153D around. By adoption of these grooves, the contacting surfaces 160A, B to 163A, B can be scaled down effectively, and at the same time, reduction in the squeeze effect can be attained.

These V-shape grooves 180 to 183 have the widths wider on the internal side than on the external side. Also, they have 190 inclinations down toward internal side. This creates favorable effect for the fuel to move in the radial direction more smoothly than otherwise.

The abovementioned two embodiments may be summarized as follows.

1. (A) The valve has the movable part (114) comprising the anchor (102) in cylindrical shape, the plunger (114A) located in the center of the anchor (102), and the valving element (114B) set up in the apex of the plunger (114A).

(B) The valve has the fixed core (107) comprising the fuel introduction hole (107D).

(C) The valve has the magnetic coil (105) to supply magnetic flux to the magnetic flux lines (140) which comprises magnetic attraction gap (136) provided in between the end face (122) of the anchor (102) and the end face of the fixed core (107).

(D) By the magnetic attraction power generated between the end face (122) of the anchor (102) and the end face of the fixed core (107) by the magnetic flux that runs through the magnetic attraction gap (136), the anchor (102) is attracted to the side of the fixed core (107) thereby driving the movable part (114), drawing up the valving element (114B) from the conical valve seat (39), and then causing the fuel passage (116A) set in the valve seat (39) to open.

(E) The anchor (102):

(a) has in its central part the recess (123) formed in a position opposite to the end face of the fuel introduction hole (107D) of the fixed core (107);

(b) has the convex areas (160-163) formed in the direction of circumference in a discontinuous manner on its end face and keeping contacts with the end face of the fixed core (107);

(c) has in its end face the concave area (122) formed in the remaining portion in the convex area (160-163); and (d) has a plurality of through holes (150-153), each hole having an opening at one end in the concave area (122) and the other opening around the plunger (114A) on the end face of the opposite side of the fixed core of the anchor (102).

2. Preferably, in the state that the convex area (160-163) of the end face (122) of the anchor (102) is in contact with the fixed core (107), at least in the portion of the through holes (150-153), the recesses (123) and the concave areas (122) standing more external than the convex areas (160-163) are communicating each other.

3. Preferably, in between openings at the adjoining through holes (150-153), grooves (180-183) are formed, projecting from the recess (123) radially-outwardly.

Thus, on the end faces (122) of the anchor (102), the openings of the through holes (150-153), convex areas (160-163), grooves (180-183), and openings of next through holes (150-153) are continuously formed one after another at a certain intervals.

4. Preferably, grooves (180-183) are V-shaped.

5. Preferably, the V-shaped grooves (180-183) are inclinatory to the side of the recess (123).

6. Specifically, the fixed core (107) is fixed inside a metallic pipe (101). The anchor (102) is disposed so as to meet the fixed core (107) face-to-face but with the magnetic attraction gap (136) separating in between. The movable part (114) is set in the metallic pipe (101) so as to be able to make reciprocating movement between the valve seat (39) and the fixed core (107). On the outside of the pipe (101), the toroidal magnetic coil (105) and the yokes (103 and 106) which are to surround the coil (105) up-and-down and around are to be fitted. The anchor (102) has a plurality of through holes for fuel passage (150-153) which extend in the axial direction while the through holes (150-153) are arranged at intervals of a certain distance in the circumferential direction. Configuration is so made that in between the through holes (150-153), the end faces to contact with the fixed core (107) are arranged at proper intervals, or in other words, in a discontinuous manner.

The reference numeral 111 in FIG. 1 denotes an annular groove disposed on the pipe member forming the magnetic flux lines 140. The annular groove forms a magnetism restriction portion and is placed in a position to face the magnetic attraction gap 136.

The above embodiments characterized by the below-mentioned configuration have attained excellent effect, gaining an advantage over the previously existing technology.

a) In the point where the colliding part or the convex area (namely the contacting surfaces 160-163) is arranged to be discontinuous, the contacting surfaces are adjacent to the through holes provided in the anchor. In other words, the upper ends or the openings of the through holes poke out in the adjacent convex area (contacting surfaces). To say more minutely, the concave areas are formed within the adjacent convex area (contacting surfaces), and the upper ends of the through holes poke out in these concave areas.

b) The through holes adjacent to the concave area in which contacting surfaces are arranged in a discontinuous manner keep communication with other parts sideways. That is, the through holes communicate with the recess 123 in the direction toward the inside of the anchor. In the direction toward the outside, the through holes can keep communication with the fuel passages of the side circumferential parts of the anchor, depending on the concave area provided on the upper end face of the anchor.

c) The throughholes positioned adjacent to where the contacting surfaces in the convex area are in a discontinuous state can form major fuel passages. That is, most fuel is supplied by way of the through holes to the fuel passage 118. Also, the fuel returns from the fuel passage 118 to the recess 123. In this case, the through hole has its opening in front of the clearance between the fuel introduction hole and the recess, and therefore, the flow of fuel is almost straight in line with the axis of the plunger with the fluid resistance being able to stay low and with the movement of the anchor sustained very smooth. As a result, considerable improvement can be seen for the response of the movable part 114 as well as the on-off function of the valve.

Other effects are available as follows.

a) The first effect is that the convex area (the contacting surface) is discontinuous in point of mutual dependency. Transfer of fuel can be made easily into or out of the convex area. The part where discontinuity takes place is adjacent to the through hole of the anchor. Therefore, when the valve is closed, the fuel pushed out by the face on the downstream side of the anchor can be easily shifted to flow upstream, and yet, supply is made to inside and outside of the convex area (contacting surface) and to the convex area (contacting surface), and thus, the stiction force due to the squeeze effect that plays as if the valving element were pasted on, is to be reduced.

In short, any anchor which is simply bored, or simply attached with the convex area (contacting surfaces), cannot be very effective. If only either the outside or inside of the convex area (contacting surfaces) is bored, transfer of fuel into or out of the convex area (contacting surfaces) may be disturbed and stiction can easily occur.

b) Since the through hole adjacent to the part at which the convex area (contacting surface) becomes discontinuous is communicating with a lateral side (the lateral side of the recess provided in the anchor), supply and transfer of fuel becomes much easier. In the case where the through hole of the anchor is facing the fixed core, the minimum cross-sectional area is formed in a gap between the fixed core and the anchor. For this reason, if only a hole is made, rough screening would not pay off. The route by which fuel is brought in is assumed to be in the order of the inside of the fixed core, the outside of the anchor, and the through hole, but the effect of the through hole seems to be underestimated. By arranging the through hole to properly communicate with the lateral side (the side of the recess provided in the anchor), the flow of the fuel becomes smoother, also making it easier to do fuel supply from the through hole. As a result, it has become possible to supply fuel to narrow gaps and openings, while it has been proved also effective to reduce stiction due to squeeze effect.

The principal fuel passage occupies the largest cross-sectional area among the like fuel passages provided in the anchor. Furthermore, the through holes constituting the principal fuel passage are adjacent to the colliding parts (contacting surfaces). Therefore, the above principal fuel passage is able to enjoy the effect of reduced fluid resistance to the maximum extent possible. Besides, since the principal fuel passage combines the function as the fuel passage for prevention of stiction, the passage can carry out the given mission without reducing the size of the magnetic attraction area.

The present invention is most suitable for the fuel injection valve used for a cylinder injection system internal-combustion engine, in which fuel is directly injected in the cylinder. It is also possible to mount this valve on an induction pipe and use it for a port-injection internal-combustion engine, in which fuel is injected in the cylinder from an induction valve.

The invention claimed is:

1. An electro-magnetic fuel injection valve, comprising:

a movable part, including a cylinder-shaped anchor, a plunger, located in the center of said anchor, and a valving element, placed in the apex of said plunger, a fixed core having a fuel introduction hole in the center to introduce fuel to the central area, and a magnetic coil to supply magnetic flux to the magnetic flux lines including the magnetic gap provided between the end face of said anchor and the end face of said fixed core; and allowing magnetic attraction force generated between the end face of said anchor and the end face of said fixed core by the magnetic flux penetrating through said magnetic gap to attract said anchor to the side of said fixed core, thus driving said movable part to pull the valving element off the valve seat permitting the fuel passage in the valve seat to be opened, wherein:

said anchor includes:

a concave part foamed in the location facing the end part of the fuel introduction hole of the fixed core in the central portion of the anchor, convex areas formed at intervals in the circumferential direction at the end faces of the anchor in contact with the end faces of the fixed core, concave areas formed in the remaining portions in the convex area at the end faces of the anchor, and a plurality of through holes, one end of each of the through holes being open in said concave areas and the other end of each of the through holes being open around said plunger on the end face of the opposite side of the fixed core;

the one end of the plurality of through holes is partly opened to the inner side of the concave part while a remaining part of the one end is opened to the concave areas opposed to an edge surface of the fixed core;

the convex areas are formed to the outer circumferential side of the concave part and the concave areas are formed to the outer circumferential side of the convex areas; and the remaining part of one end opened to the concave areas intervenes between the convex areas adjoining to each other in a circumferential direction.

2. The electro-magnetic fuel injection valve according to claim 1, wherein:

while said convex areas of the end faces of said anchors being in the state of contacting with said fixed core, at least at said places of through holes, communication is kept between said concave areas and the concave areas in the outer circumference and beyond of said convex areas of said anchors.

3. The electromagnetic fuel injection valve according to claim 1, wherein:

in between said adjoining openings of through holes, grooves are being formed radially-outwardly from said convex areas and thus, on the end faces of said anchor, openings of the through holes, convex areas, said grooves, and openings of subsequent through holes are being formed alternately, and one after another at a certain intervals in between.

4. The electro-magnetic fuel injection valve according to claim 3, wherein:

said grooves are of V-shape.

5. The electro-magnetic fuel injection valve according to claim 4, wherein:

said V-shaped grooves are aslant toward said concave areas.

6. A fuel injection valve comprising a fixed core with a fuel passage in its center and a valve member driven together with an anchor by attracting the anchor to an end face of the fixed core through electro-magnetic force to opens/closes a fuel injection orifice thereby, wherein:

the anchor has a plurality of projections disposed at specific intervals on an end face of the anchor, each of the projections has a contact surface to touch to the end face of the fixed core, a through hole is bored between the contact surfaces of the projections, an opening portion of the through hole communicates between inside circumference side and outside circumference side of the anchor, one end of the through hole is partly opened to the inner side of a concave part of the anchor while a remaining part of the one end is opened to concave areas of the anchor opposed to an edge surface of the fixed core, convex areas are formed to the outer circumferential side of the concave part and the concave areas are formed to the outer circumferential side of the convex areas, and the remaining part of the one end opened to the concave areas intervenes between the convex areas adjoining to each other in a circumferential direction.

* * * * *